US012109481B2

(12) United States Patent
Stagner

(10) Patent No.: US 12,109,481 B2
(45) Date of Patent: Oct. 8, 2024

(54) SKATEBOARD TRUCK MOUNTING SYSTEM

(71) Applicant: Sean D. Stagner, Santa Ana, CA (US)

(72) Inventor: Sean D. Stagner, Santa Ana, CA (US)

( * ) Notice: Subject to any disclaimer, the term of this patent is extended or adjusted under 35 U.S.C. 154(b) by 40 days.

(21) Appl. No.: 18/059,412

(22) Filed: Nov. 28, 2022

(65) Prior Publication Data

US 2024/0173613 A1 May 30, 2024

(51) Int. Cl.
*A63C 17/01* (2006.01)

(52) U.S. Cl.
CPC ..... *A63C 17/017* (2013.01); *A63C 17/012* (2013.01); *A63C 17/015* (2013.01); *A63C 2203/42* (2013.01)

(58) Field of Classification Search
CPC . A63C 17/012; A63C 2203/42; A63C 17/017; A63C 17/015
See application file for complete search history.

(56) References Cited

U.S. PATENT DOCUMENTS

| | | | | |
|---|---|---|---|---|
| 7,070,193 | B2 | 7/2006 | Yamaguchi | |
| 9,878,230 | B1 * | 1/2018 | Seele | A63C 17/012 |
| 10,806,989 | B2 | 10/2020 | Johnson | |
| 2004/0040996 | A1 | 3/2004 | Chang | |
| 2004/0041360 | A1 * | 3/2004 | Lukoszek | A63C 17/01 280/11.27 |
| 2007/0029750 | A1 | 2/2007 | Gregory | |
| 2015/0202526 | A1 * | 7/2015 | Rawlins | A63C 17/017 280/87.042 |
| 2015/0360119 | A1 * | 12/2015 | Carlson | A63C 17/017 29/897.1 |
| 2019/0282888 | A1 * | 9/2019 | Johnson | A63C 17/02 |
| 2020/0346100 | A1 * | 11/2020 | Liniado | A63C 17/014 |

FOREIGN PATENT DOCUMENTS

| | | |
|---|---|---|
| CN | 208448604 | 2/2019 |
| CN | 110465070 | 11/2019 |
| JP | 2018517530 | 7/2018 |

* cited by examiner

*Primary Examiner* — Brian L Swenson
(74) *Attorney, Agent, or Firm* — DANE IP Law PC

(57) ABSTRACT

A skateboard truck system is configured so that a hanger assembly can be quickly and easily removed and replaced without use of tools and while maintaining stability and high performance. The truck system comprises a deck plate that is configured to be permanently attached to a skateboard deck. A base can be releasably coupled to the deck plate. A conventional hanger assembly can be attached to the base.

20 Claims, 17 Drawing Sheets

SKATEBOARD TRUCK MOUNTING SYSTEM

CROSS-REFERENCE TO RELATED APPLICATIONS

Not applicable.

BACKGROUND

The present disclosure relates to the field of skateboard trucks.

Skateboard truck assemblies typically are mounted to skateboard decks using bolts and locknuts. Wheels for such truck assemblies are also typically mounted using locknuts. While this is generally a secure arrangement, it can be difficult and time-consuming to change to a different type of truck or wheel, requiring removal and replacement of the locknuts.

Quick-release truck assemblies exist that attempt to address this issue. However, quick-release truck assemblies can be inconvenient to use and/or compromise truck performance. For example, existing quick-release truck assemblies can result in too much play between truck members and can be too easily subject to breakage. Further, they can add height not present in typical trucks, thus limiting and compromising skateboard performance characteristics.

SUMMARY

The present disclosure describes aspects of a skateboard truck system that allows quick and easy removal and replacement of a skateboard truck and wheels without using tools. The truck system also provides a secure and high-performance fit when assembled. Further, the truck system is configured to support the truck hanger and wheels at substantially the same distance from the corresponding skateboard deck as a conventional truck system.

A deck plate can be mounted to a typical skateboard deck in a permanent manner such as using multiple bolts and locknuts. A primary pocket is formed in the deck plate. A base is formed separately from the deck plate and is configured to support a conventional hanger assembly thereon by way of a conventional kingpin and pivot. The base has a primary insert that can be advanced into and received by a primary pocket of the deck plate. A spring-biased retaining member is movably supported by the deck plate adjacent the primary pocket. The retaining member can be pushed out of the way to enable the primary insert to be advanced into the primary pocket, but once the primary insert passes the retaining member, the retaining member automatically moves into place adjacent the primary insert, blocking it from moving out of the primary pocket. The primary pocket defines surfaces that register with surfaces of the primary insert so as to block relative movement in all linear and rotational directions. Thus, the base is securely held in place by the deck plate. To remove the base from the deck plate, a user can depress buttons to move the retaining member out of the way of the primary insert. The primary insert can then be drawn out of the primary pocket so as to remove the base from the deck plate.

A secondary pocket can be formed in the deck plate and spaced from the primary pocket. The base can have a secondary insert portion spaced from the primary insert portion. The secondary insert portion can be received into and at least partially restrained in the secondary pocket. As the primary insert is being received into the primary pocket the secondary insert is simultaneously being received into the secondary pocket. The secondary pocket defines surfaces that register with surfaces of the secondary insert to also block relative movement in at least forward and side-to-side linear directions. Additional surfaces engage with surfaces of the deck plate to block relative rotation about all axes. The primary insert can be disposed in a proximal portion of the base, while the secondary insert can be disposed in a distal portion of the base.

In accordance with one embodiment, the present specification provides a skateboard truck system, which comprises a deck plate having a bottom surface configured to rest against a skateboard deck and a top surface spaced from the bottom surface, a primary pocket comprising opposing side surfaces and a primary retaining member above each side surface and extending toward an axis of the deck plate, the primary retaining member defining a retaining surface facing away from the top surface, and a track adjacent the primary pocket. The truck system also comprises a retaining member slidably disposed in the track and spring-biased toward a locking position. A base of the truck system has a primary insert, a seat surface and a pivot receiver, the seat surface and pivot receiver configured so that a hanger assembly can be mounted onto the base, the primary insert having an upper surface, side walls, and a back wall. The primary insert and primary pocket are sized and configured so that the primary insert can be received within the primary pocket, and when the primary insert is received within the primary pocket the retaining member is in the locking position, the primary insert side walls register with the primary pocket side walls, the primary insert upper surface registers with the primary pocket retaining surfaces, and the primary insert back surface registers with the retaining member.

In a variation, the base comprises a support surface, and wherein when the primary insert is received within the primary pocket the support surface is engaged with the top surface of the deck plate.

In another variation, the access port is sized and configured to accommodate the primary insert passing therethrough, the retaining member positioned to block the access port when the retaining member is in the default position.

In accordance with another embodiment, the present invention provides a skateboard truck system comprising a deck plate and a base. The deck plate has a bottom surface configured to rest against a skateboard deck and a top surface spaced from the bottom surface, a primary pocket comprising a plurality of primary surfaces, and a secondary pocket comprising a plurality of secondary surfaces, the secondary pocket being spaced from the primary pocket. The base has a primary insert having a plurality of primary insert surfaces, a secondary insert having a plurality of secondary insert surfaces, a seat surface and a pivot receiver. The seat surface and pivot receiver are configured so that a hanger assembly can be mounted onto the base. The base and deck plate are sized and configured so that the base can be selectively coupled with the deck plate by advancing the primary insert into the primary pocket and the secondary insert into the secondary pocket. The primary insert surfaces are configured to register with the primary surfaces so as to block lateral movement of the base relative to the deck plate. The secondary insert surfaces are configured to register with the secondary surfaces so as to block lateral movement of the base relative to the deck plate.

In a variation, the deck plate additionally defines a track adjacent the primary pocket, and a retaining member is disposed within the track and configured to slide within the track, the retaining member being biased toward a default position. In another such variation, the deck plate additionally comprises an access port aligned with the primary pocket, the access port sized and configured to accommodate the primary insert passing therethrough, the retaining member positioned to block the access port when the retaining member is in the default position.

In a still further variation, the secondary pocket comprises a secondary aperture formed through the bottom surface of the deck plate, the secondary aperture having a front surface and a back opening. The secondary aperture is unobstructed moving longitudinally from the back opening to the front surface. In a further such variation, the secondary insert is configured to slide within the secondary pocket so that a front wall of the secondary insert engages a front wall of the secondary pocket when the base is coupled with the deck plate.

In yet another variation, the primary insert is configured to fit through the access port when inclined at an angle between 15-75 degrees relative to the deck plate.

In a yet further variation, the base comprises a proximal portion and a distal portion, the primary insert being formed in the primary portion, the secondary insert being formed in the distal portion. In some such variations, a distal portion of the deck plate at or adjacent the secondary pocket comprises a base support surface and a plate lock surface, and a distal lock portion is formed in the distal portion of the base, and wherein the distal lock portion is sized and configured to slide into a lock space between the plate lock surface and the base support surface.

In still another variation, when the base is coupled with the deck plate a bottom surface of the secondary insert is generally even with a bottom surface of the deck plate. Such a variation can be configured so that when the base is coupled to the deck plate a bottom surface of the primary insert is spaced from the bottom surface of the deck plate.

In a yet further variation a distal extension is formed on the base, and a separately-formed socket is configured to be releasably attached to the distal extension, the socket defining a keyed cavity sized and configured to complementarily fit with a nut of a hanger assembly.

In another embodiment, the present specification provides a method of assembling a skateboard truck system. The method comprises advancing a base toward a deck plate that is attached to a skateboard deck in a manner so that a bottom surface of the deck plate is engaged with the skateboard deck, a top surface of the deck plate defining an access port therethrough, a primary pocket being adjacent the access port, a retainer member disposed within the access port and being slidable between an open position and a default position, the retainer member being biased to the default position. The method further includes advancing a primary insert of the base into the access port at an incline between 15-75 degrees relative to the deck plate bottom surface, rotating the base, and advancing the base longitudinally relative to the deck plate in a direction parallel to the deck plate bottom surface to a coupled position. When the base is in the coupled position a plurality of primary insert surfaces engage a corresponding plurality of primary pocket surfaces so as to block movement of the base relative to the deck plate.

In some variations, when the primary insert is advanced into the access port at an incline, the primary insert pushes the retainer member out of the way, and when the base is advanced longitudinally relative to the deck plate the primary insert moves over the retainer member.

In some such variations, when a back wall of the primary insert is advanced past the retainer member, the retainer member is again biased to the default position.

In additional variations, the deck plate comprises a secondary pocket spaced longitudinally from the primary pocket, the secondary pocket comprising a secondary aperture formed through the deck plate and defining a front wall, opposing side walls, and a back opening. When the base is advanced longitudinally relative to the deck plate in the direction parallel to the deck plate bottom surface a secondary insert of the base advances through the back opening and into the primary secondary pocket.

In some such variations, when the base is in the coupled position, a front wall of the secondary insert is engaged with the front wall of the secondary aperture.

DESCRIPTION

Figure 1:
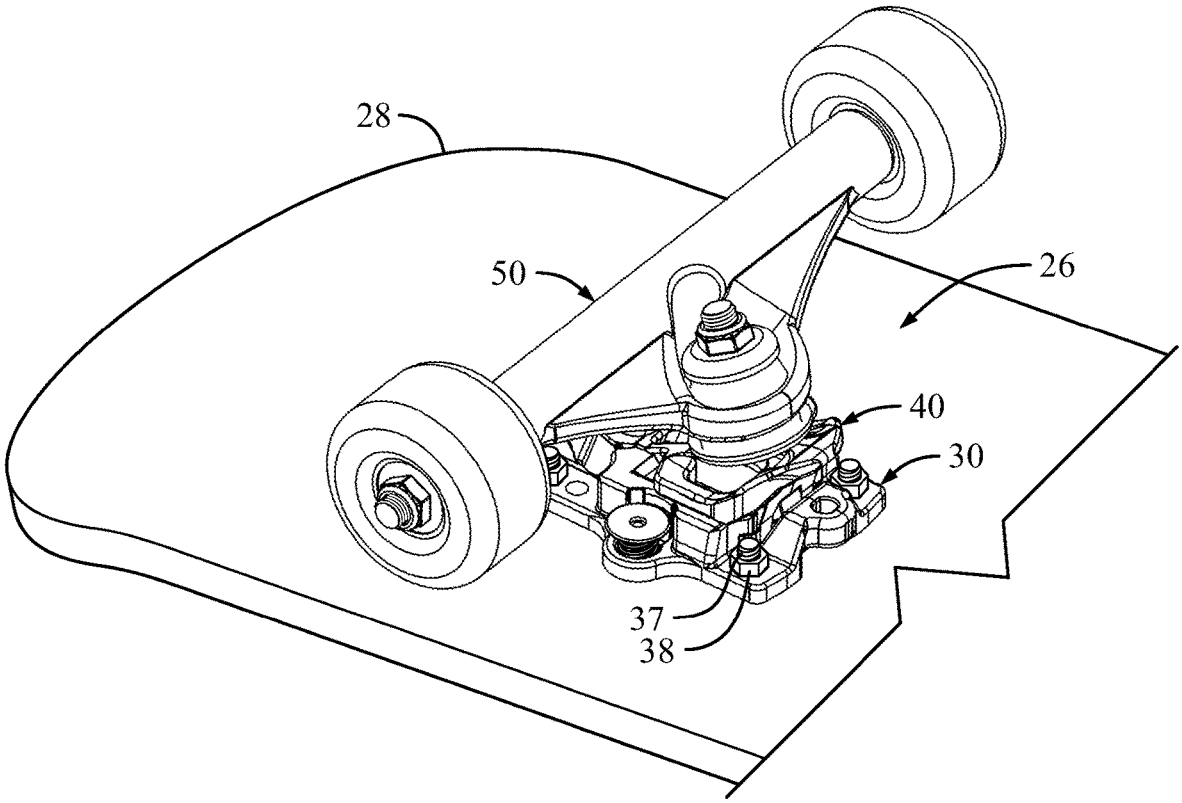
FIG. 1 is a perspective view showing a truck system having features of a preferred embodiment mounted on a skateboard deck.

The present disclosure describes aspects of a skateboard truck system that allows quick and easy removal and replacement of a skateboard truck without using tools. The truck system also provides a secure and high-performance fit when assembled. Further, the truck system is configured to support the truck hanger and wheels at substantially the same distance from the corresponding skateboard deck as a conventional truck system.

As will be discussed in more detail below, a deck plate 30 (sec FIGS. 1 and 2) can be mounted to a typical skateboard deck 28 in a permanent manner such as using multiple bolts and locknuts. A primary pocket 42 (see FIG. 2) and a secondary pocket 46 (see FIG. 2) are formed in the deck plate 30 and can be longitudinally spaced from one another. A base 40 (see FIGS. 1 and 2) is formed separately from the deck plate 30 and is configured to support a conventional hanger assembly 50 (see FIG. 6) thereon by way of a conventional kingpin and pivot (see FIG. 1). The base 40 has a primary insert portion 44 (see FIGS. 2 and 5) and a secondary insert portion 48 (see FIGS. 2 and 5) which can be advanced (see FIGS. 3 and 11) into the deck plate 30 so that the primary insert 44 is received into and held securely in the primary pocket 42 and the secondary insert 48 is received into and at least partially restrained in the secondary pocket 46 (see FIGS. 4 and 12).

A spring-biased retaining member 160 (see FIG. 2) is movably supported by the deck plate 30 adjacent the primary pocket 42. The retaining member 160 is biased toward the wheels of the skateboard with the spring. The retaining member 160 can be pushed out of the way with the primary insert 44 to enable the primary insert 44 to be received into the primary pocket 42, but once the primary insert 44 is received, the retaining member 160 automatically moves into place adjacent (e.g., behind) the primary insert 44 so as to block the primary insert 44 (see FIG. 12) from moving backwards out of the primary pocket 42. As the primary insert 44 is being received into the primary pocket 42 the secondary insert 48 is simultaneously being received into the secondary pocket 46. The primary pocket 42 defines surfaces 140, 142, 149 (see FIGS. 7 and 10) that register with surfaces 68, 76, 72 (see FIGS. 5 and 10) of the primary insert 44 so as to block relative movement of the base 40 relative to the deck plate 30. Put simply, the base 30 doesn't wiggle within the deck plate 40 during use. The secondary pocket 46 defines surfaces 144, **144*a*, 146 that register with surfaces 88, 88*a*, 86 of the secondary insert 48 to also block relative movement of the base 40 relative to the deck plate 30. Thus, the base 40 is securely held in place by the deck plate 30. To remove the base 40 from the deck plate 30, a user can depress buttons 176 (see FIG. 4) to move the retaining member 160 out of the way of the primary insert 44. The primary insert 44 can then be drawn out of the primary pocket 42 so as to remove the base 40 from the deck plate 30**.

With initial reference to FIG. 1, a skateboard truck system 26 is illustrated comprising a deck plate 30 that is configured to be attached to the bottom surface of a skateboard deck 28. A base 40 of the truck system 26 can be configured to support a typical truck hanger assembly 50 that includes a hanger 52 and wheels 53. The illustrated base 40 is formed separately from the deck plate 30 and can be selectively engaged and disengaged with the deck plate 30 so as to remove the hanger assembly 50 from the skateboard deck 28, while the deck plate 30 stays in place. Preferably both the deck plate 30 and base 40 are unitarily formed of a rigid, sturdy material such as aluminum or steel.

In the present specification relative vertical positions of structures will be discussed in a context in which the truck system is disposed generally as depicted in FIG. 1, in which a bottom surface 134 (see FIG. 7) of the deck plate 30 is attached to a skateboard deck 28 that is disposed upside-down so that the bottom surface 134 sits in a longitudinal plane. Terms relevant to relative height are to be take in this context. For example, in FIG. 1, the hanger assembly 50 is vertically above, or higher than, the deck plate 30.

Figure 2:
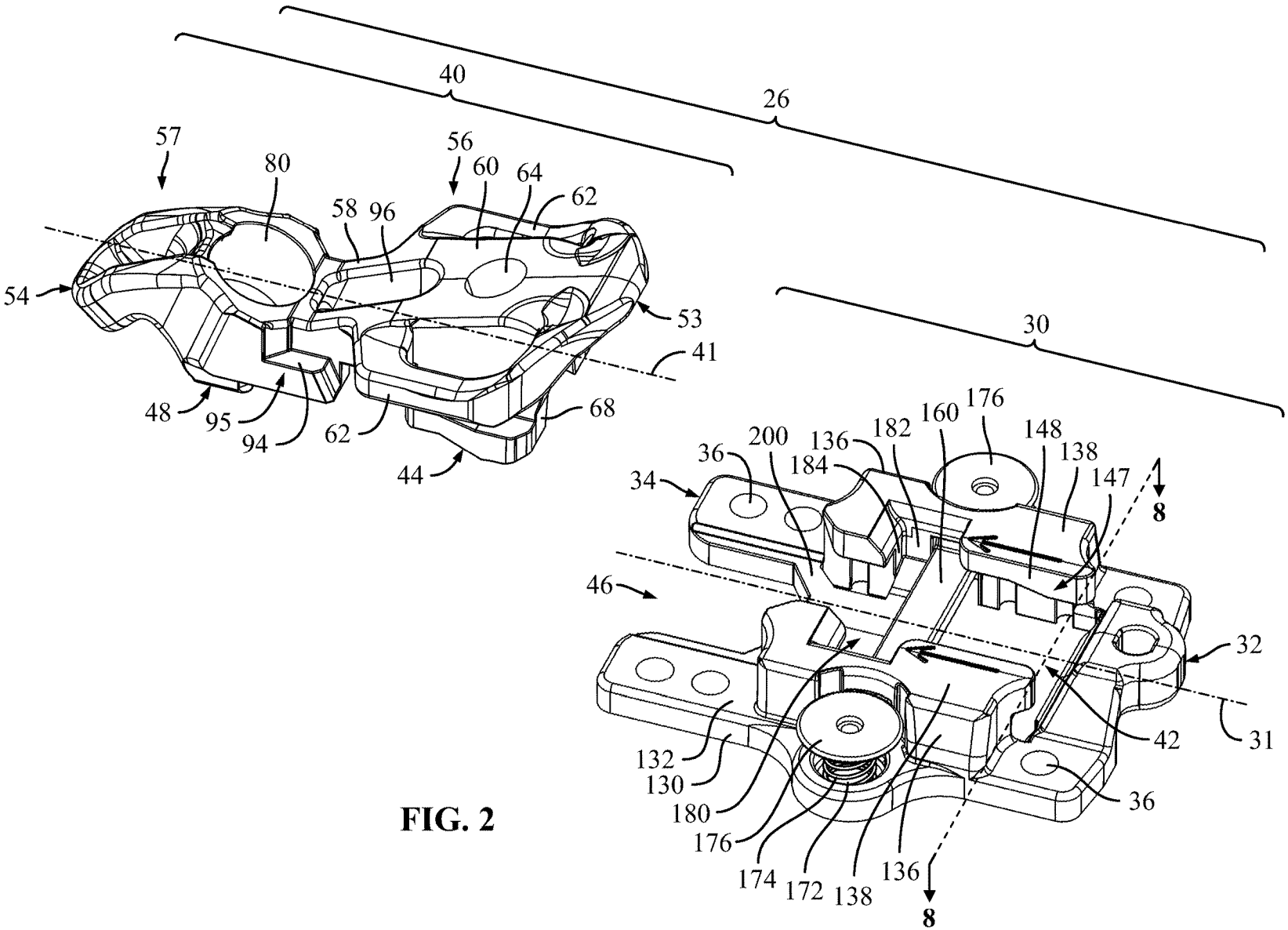
FIG. 2 is a perspective view separately showing a deck plate and a base of the truck system of FIG. 1.
Figure 5:
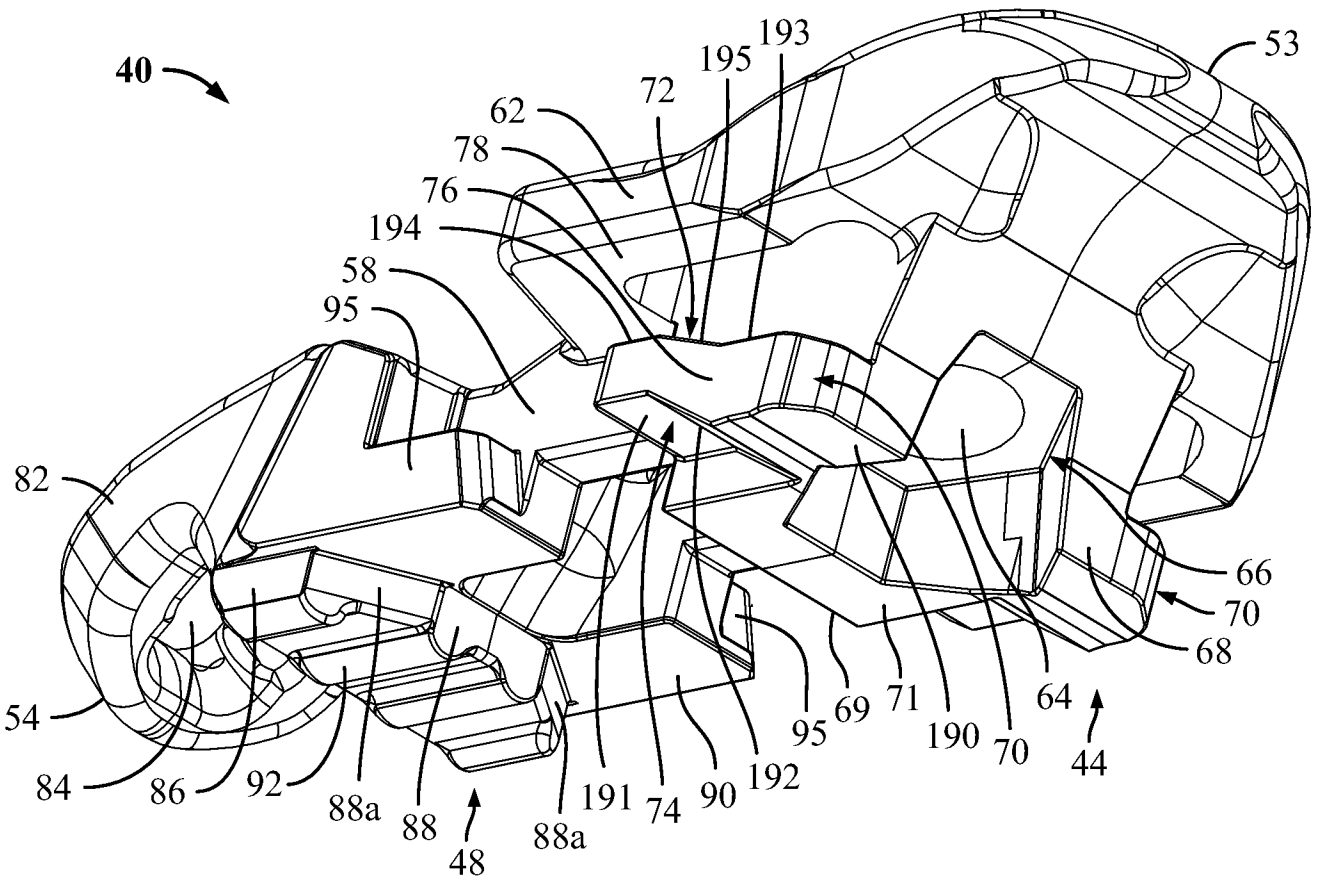
FIG. 5 is a bottom perspective view of the base of FIG. 2.

With additional reference to FIGS. 2 and 5, the deck plate 30 is elongated along a longitudinal axis 31, extending from a proximal end 32 to a distal end 34. Mounting holes 36 can be disposed adjacent each corner of the deck plate 30. The deck plate 30 can be securely and/or semi-permanently attached to the skateboard deck 28 by conventional fasteners, such as bolts 37 and locknuts 38.

The base 40 is also elongated, extending along a longitudinal axis 41 from a proximal end 53 to a distal end 54. A proximal portion 56 of the base 40 is separated from a distal portion 57 of the base 40 by a waist 58 at which a width of the base 40 is decreased relative to the proximal portion 56 and distal portion 57. A seat surface 60 is formed on the top of the proximal portion 56 and preferably is inclined. Wings 62 extend outwardly from relative to the longitudinal axis 41 in the proximal portion 56. A kingpin aperture 64 extends through the base 40, opening through the seat surface 60. On the other side of the base 40, the kingpin aperture 64 opens to a kingpin head space 66 formed in the primary insert 44. The kingpin head space 66 is configured to accept and make room for the kingpin head 104 (see FIG. 6), as will be discussed in more detail below.

Many of the figures show the base 40 and deck plate 30 without depicting the hanger assembly 50 attached to the base 40. This has been done to simplify the drawings. It is to be understood that interaction of the base 40 and deck plate 30 as discussed herein can all be performed with the hanger assembly 50 attached to the base 40.

With continued reference to FIGS. 2 and 5, the primary insert 44 preferably includes a front wall 68 defined along its proximal end and a back wall 69 defined along its distal end. Insert extensions 70 extend outwardly from the axis 41 of the base 40 and each terminates in a side wall 76. Each insert extension 70 defines an upper contoured surface 72 and a bottom contoured surface 74. A proximal support surface 78 is defined on each of the wings 62 generally opposite the upper contoured surface 72 of the adjacent insert extension 70 so that the proximal support surface 78 and upper contoured surface 72 are vertically spaced from one another.

With continued reference to FIGS. 2 and 5, the distal portion 57 of the base 40 defines a pivot cup 80 configured to receive a pivot 118 (see FIG. 6) of a typical hanger assembly 50, as will be discussed in more detail below. A distal extension 82 can extend distally from the distal portion 57. An extension aperture 84 can be formed through the distal extension 82.

The secondary insert 46 includes a pair of opposing side walls 86 and a front wall 88. The front wall 88 can include tapered portions **88*a* that intersect adjacent side walls 86. A distal support surface 90 is defined in the distal portion 57 generally vertically higher than a bottom surface 92 of the secondary insert 46. A distal lock surface 94 is also defined in the distal portion 57 generally vertically higher than the distal support surface 90. The distal lock surface 94 and distal support surface 90 can be formed on opposite sides of a distal lock part 95 of the distal portion 57. A waist aperture 96 can extend through the base 40 at the waist 58**. Other apertures may also be included in order to, for example, reduce weight.

Figure 6:
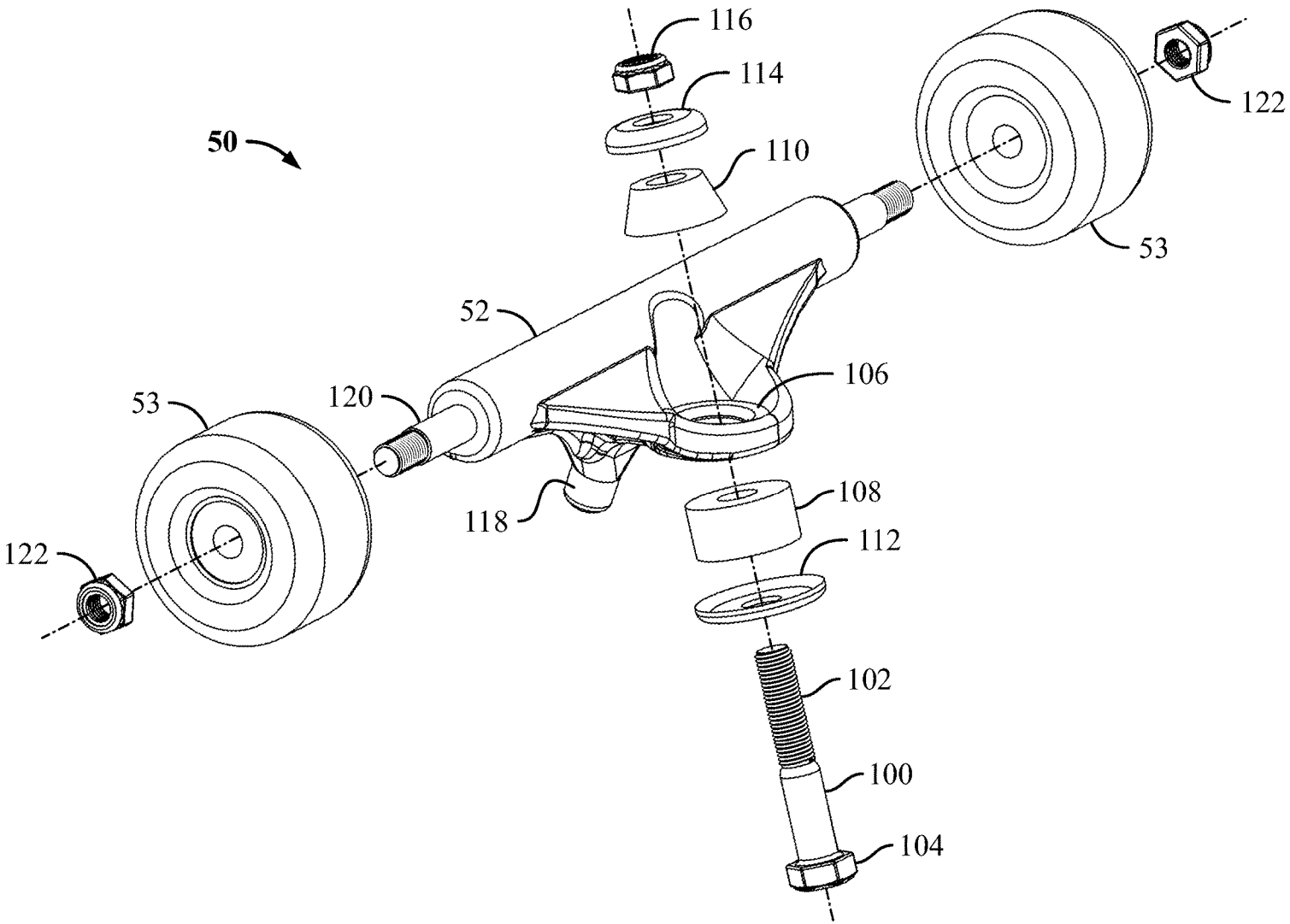
FIG. 6 is an exploded view of a hanger assembly of the truck system of FIG. 1.

With reference next to FIG. 6, the elongated kingpin 100 includes a threaded portion 102 and a kingpin head 104. The kingpin 100 can be advanced through the kingpin aperture 64 of the base 40. The kingpin head 104 is retained in the head space 66 and the threaded portion 102 extends upwardly through and out of the seat surface 60. The hanger 52 includes a bushing seat 106, which is shaped and configured to accept a bottom bushing 108 on a bottom side and a top bushing 110 on a top side. The bushing seat 106 can be generally cup-shaped on one or both sides to accommodate the bottom and top bushings 108, 110. Such bushings can be shaped in various ways, such as being cylindrical or generally conical. A bottom washer 112 engages the bottom bushing 108, and a top washer 114 engages the top bushing 110. The washers 112, 114 can be cup-shaped so as to receive the respective bushings 108, 110. Preferably, the bottom washer 112, bottom bushing 108, bushing seat 106, top bushing 110, and top washer 114 all advanced over the threaded portion 102 of the kingpin 100, with the bottom washer 112 seated upon the seat surface 60. Simultaneously, the pivot 118 preferably is inserted into the pivot cup 80 of the base 40. The kingpin nut 116 can be threaded onto the kingpin 100 to secure the hanger assembly 50 in place. The hanger 52 further includes an elongated axle 120 that supports the wheels 53. Axle nuts 122 can retain wheels in place on the axle 120. When installed as described, the hanger 52 will be held securely in place, but forces applied to the ends of the hanger 52 will enable it to pivot in order to allow steering of the associated skateboard in a typical manner.

Figure 7:
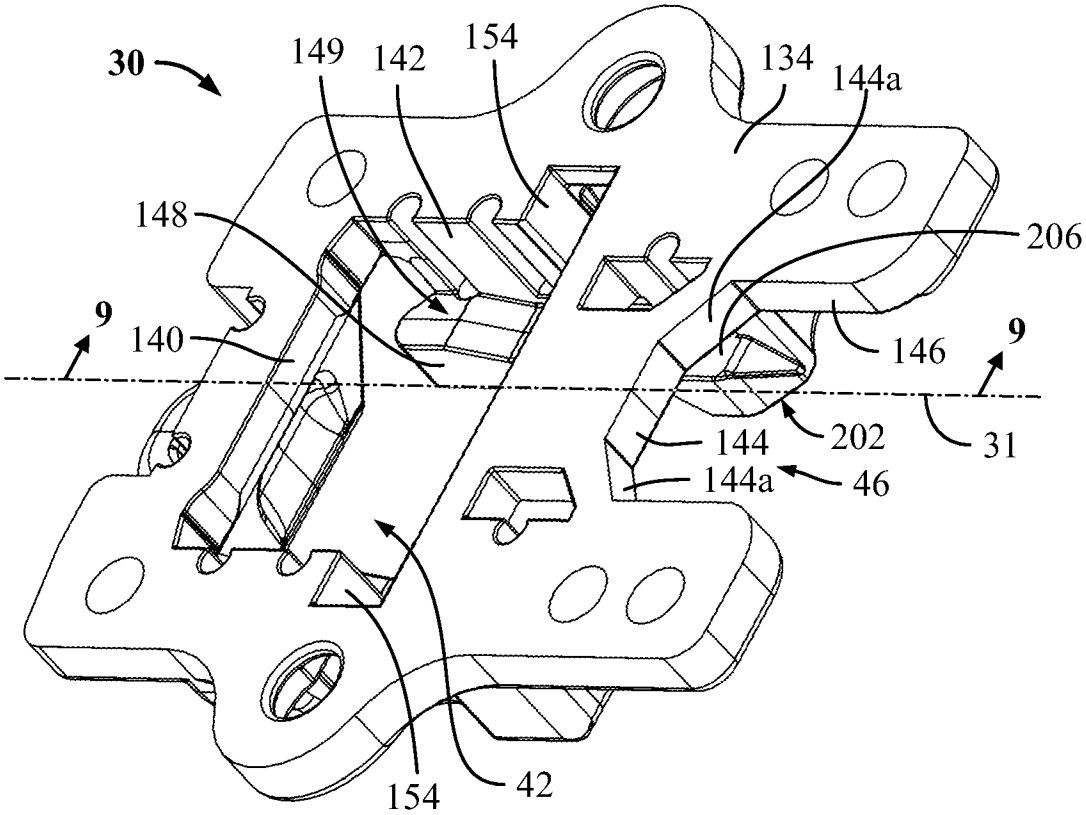
FIG. 7 is a bottom perspective view of the deck plate of FIG. 2.

With reference next to FIGS. 2 and 7, the deck plate 30 comprises a platform portion 130 having a platform upper surface 132 and a bottom surface 134. Raised portions 136 extend upwardly from the platform portion 130 on opposite sides of the axis 31. Each raised portion 136 terminates at a plate surface 138. The raised portions 136 can be spaced apart from one another and are formed to be generally symmetrical to one another.

Figure 9:
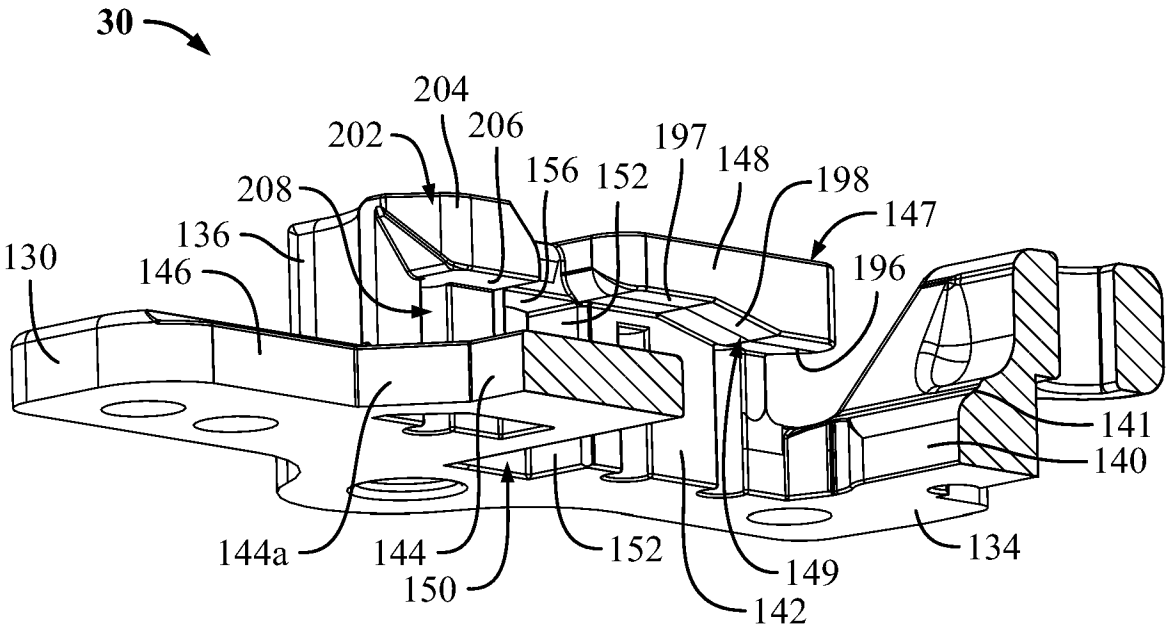
FIG. 9 is a cross-sectional view taken along line 9-9 FIG. 7.
Figure 10:
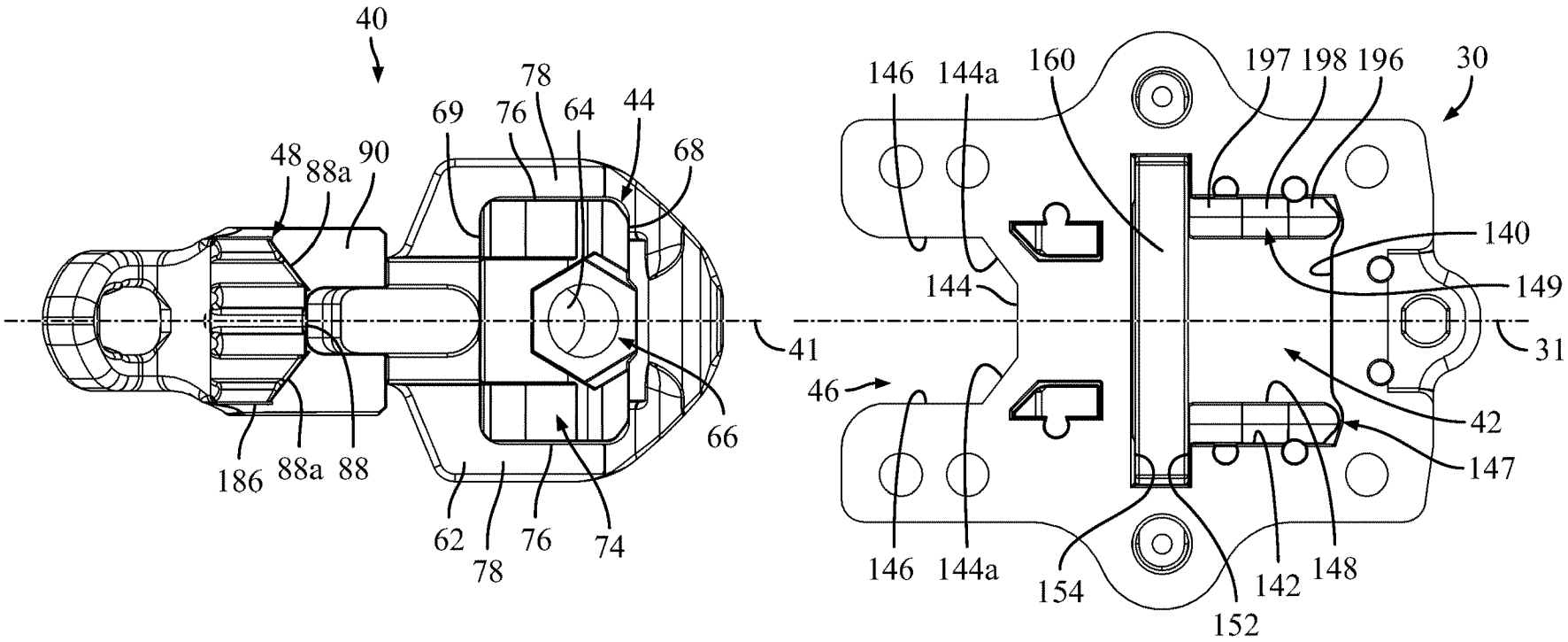
FIG. 10 is an orthographic bottom view of the deck plate and base of FIG. 2.

With additional reference to FIGS. 9 and 10, the primary pocket 42 comprises an aperture formed through the deck plate 30 and defines a front wall 140 and opposing side walls 142. The illustrated secondary pocket 46 also comprises an opening formed through the deck plate 30 and defines a front wall 144 and opposing side walls 146. The front wall 144 can have tapered portions 144*a* that are disposed at an obtuse angle relative to the front wall 144. The back, or distal end of the secondary pocket 46 can be open. Preferably the front wall 144 and side walls 146 are complementary to the front wall 88 and side walls 86 so that the front and side walls 88, 86 of the secondary insert 46 register with the secondary pocket front and side walls 144, 146 in a manner so that forward, side-to-side, and rotational movement of the secondary insert 46 relative to the deck plate 30 about a vertical axis are blocked. Similarly, the front wall 140 and side walls 142 of the primary pocket 42 are complementary to the front wall 68 and side walls 76 of the primary insert 44 so that the front and side walls 68, 76 of the primary insert 44 register with the primary pocket front and side walls 130, 132 so that forward, side-to-side, and rotational movement of the primary insert 44 relative to the deck plate 30 about a vertical axis are blocked.

Continuing with reference to FIGS. 2, 7, 9 and 10, primary retaining members 147 are formed in the raised portion 136 and extend inwardly towards the axis 31, terminating in an upper side wall 148 that is disposed vertically above the side walls 142. Each primary retaining member 147 defines a contoured retaining surface 149 disposed generally opposite the plate surface 138.

Continuing with reference to FIGS. 2, 7 and 9, a retaining member track 150 is defined in the deck plate 30 by generally vertical track front walls 152 and track back walls 154. The retaining member track 150 can be open through the bottom surface 134. As illustrated, the retaining member track 150 terminates at a track top wall 156 that is within the raised portion 136 generally opposite and below the plate surface 138.

Figure 8A:
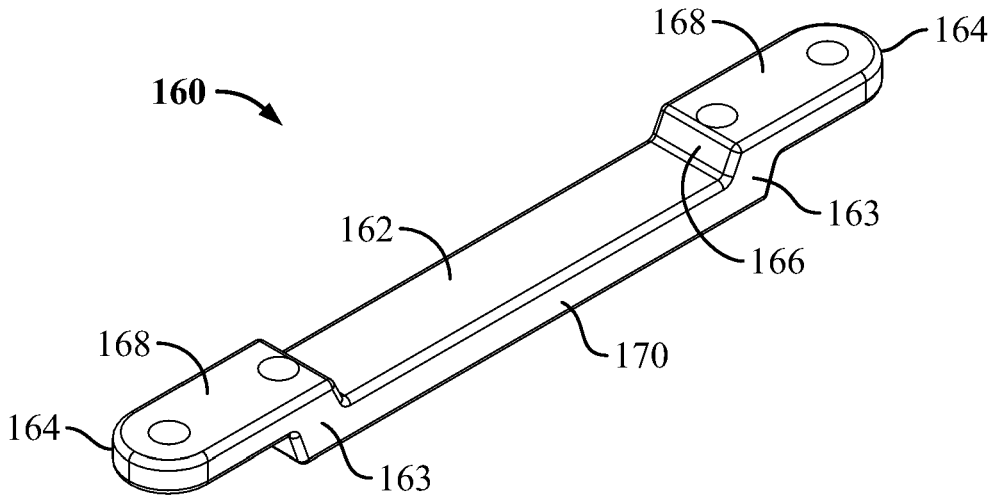
FIG. 8*a* is a perspective view of the retaining member also shown in FIG. 8.
Figure 8:
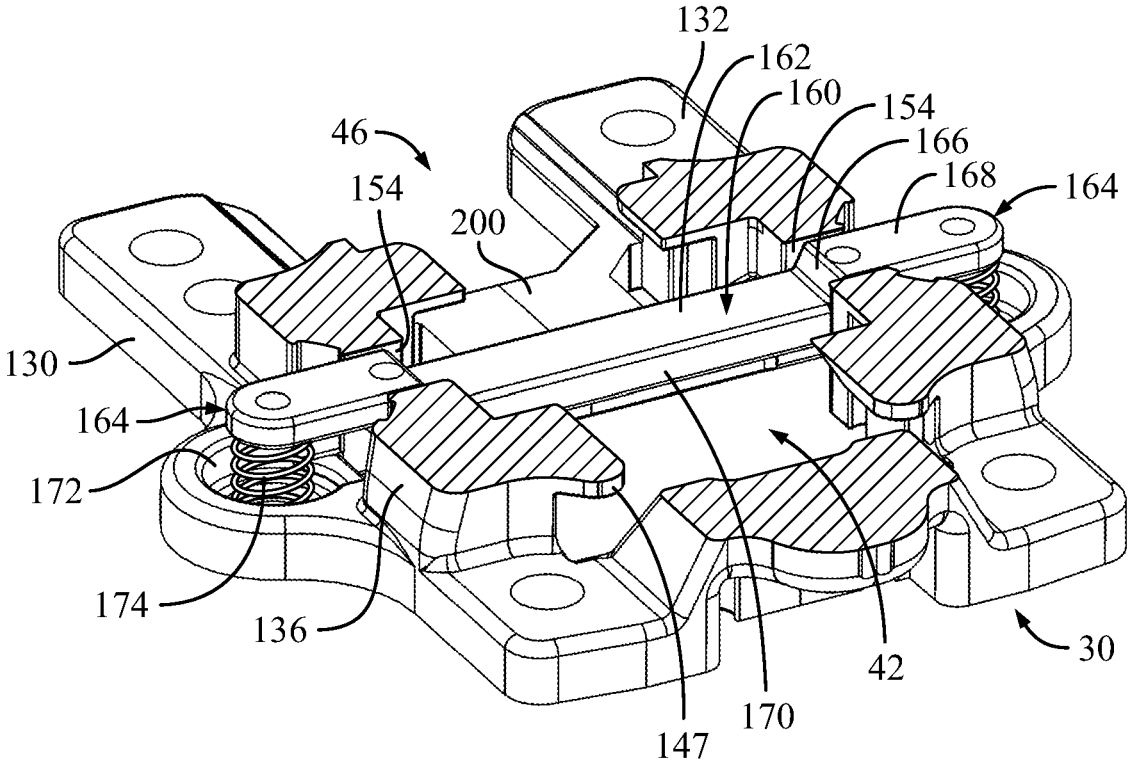
FIG. 8 is a cross-sectional view taken along line 8-8 of FIG. 2.

With particular reference next to FIGS. 8 and 8*a*, a retaining member 160 is configured to move vertically within the retaining member track 150. The illustrated retaining member 160 comprises an elongated body 162 that, as illustrated, is shaped as an elongated bar having a generally rectangular cross-section. The retaining member 160 terminates at end portions 164. The elongated body 162 transitions to the end portions 164 at offsets 166 that extend vertically from the elongated body 162 so that the end portions 164 are generally vertically higher than the elongated body 162. Thickened portions 163 are formed adjacent the offsets 166, and a top-to-bottom thickness of the retaining member 160 is greatest at the thickened portions 163. As shown, the thickened portions 163 of the retaining member 160 are arranged between the track front wall 152 and track back wall 154. A front-to-back width of the retaining member 160, particularly at the thickened portions 163, approximates, but is slightly less than, the distance between the track front wall 152 and track back wall 154 so that the retaining member 160 can slide vertically up and down within the retaining member track 150, but the thickened portions 163 can engage the track back wall 154 and track front wall 152 to resist twisting of the retaining member 160 about its longitudinal axis. The track front wall 152 blocks forward movement of the retaining member 160, and the track back wall 154 blocks backward movement of the retaining member 160. Vertical travel of the retaining member 160 is also limited, as eventually the upper surface 168 of the end portions 164 will come in contact with the track top wall 156, which blocks any further vertical movement. A front surface 170 of the elongated body 162 comprises a blocking surface 170 which, as will be discussed in more detail below, helps retain the primary insert 44 of the base 40 within the primary pocket 42. Tips of the end portions 164 extend above spring seats 172 formed in the platform portion 130 of the deck plate 30. Springs 174 extend between each spring seat 172 and a bottom surface of each end portion 164. Each spring 174 biases the retaining member 160 vertically upwardly, preferably into contact with the track top wall 156. As such, when the retaining member 160 is biased upwardly into contact with the track top wall 156 it is considered to be in a default position. As shown in FIG. 2, buttons 176 can be placed atop each upper surface 168 so that a user actuating the buttons 176 can push the end portions 164, and thus the associated retaining member 160, downwardly and out of the way of the primary insert 44, enabling the primary insert 44 to be removed from the primary pocket 42.

With specific reference next to FIG. 2, an access port 180 is formed in the deck plate 30 immediately distal of the primary pocket 42 and communicating with the primary pocket 42. The access port 180 is defined by side access walls 182 and back access walls 184 formed in the raised portion 136. The side access walls 182 are each at least as far from the axis 30 as are the side walls 132 of the primary pocket 42.

Figure 3:
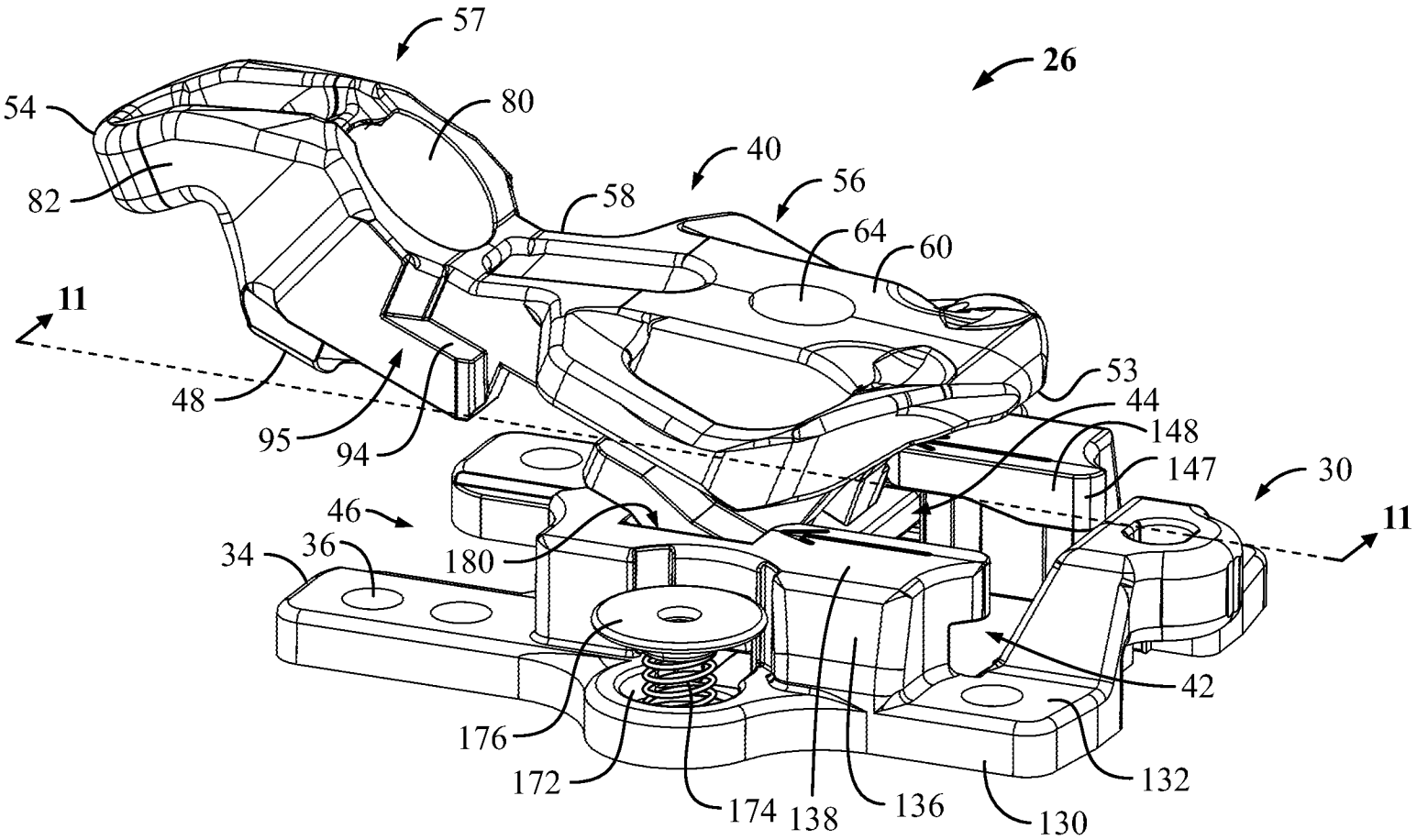
FIG. 3 is a perspective view showing the base of FIG. 2 during a connection operation with the deck plate.
Figure 11:
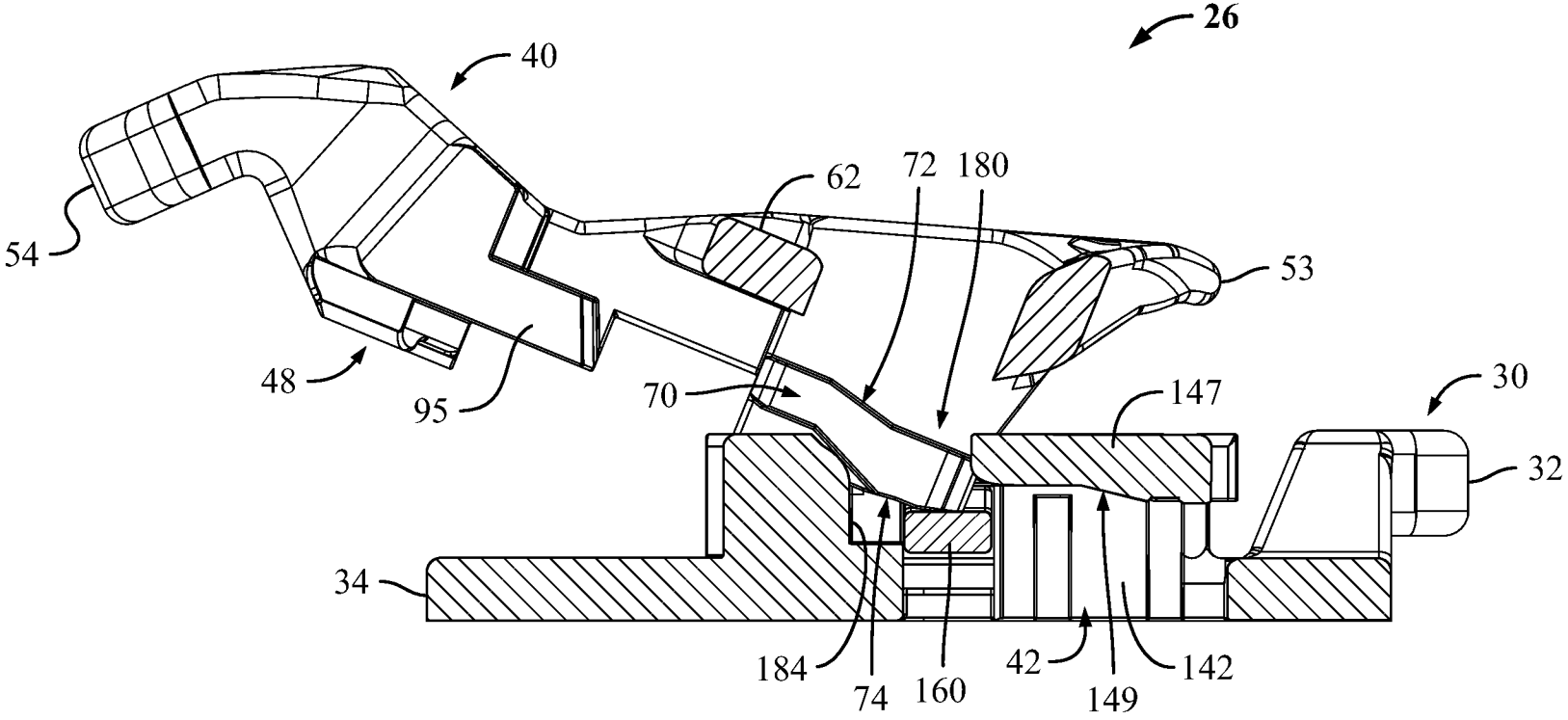
FIG. 11 is a cross-sectional view taken along line 11-11 of FIG. 3.

With additional reference to FIGS. 3 and 11, the access port 180 is sized and configured so that a proximal end of the primary insert 44 can pass therethrough. As shown, the base 40 can be inclined relative to the deck plate 30 and the primary insert 44 can be advanced through the access port 180 so that the front wall 68 engages a top surface of the retaining member 160 as depicted in FIGS. 3 and 11. Further advancement of the base 40 will cause the retaining member 160 to be pushed vertically downwardly and out of the way, enabling the primary insert 44 to be advanced. During such advancement, the insert extensions 70 will slide below the restraining members 147 and the back wall 69 will move proximally of the back access wall 184. At entry into the access port 180, the base is inclined between about 15-75 degrees relative to horizontal, or the bottom surface 134 of the deck plate 30. In variations, the entry incline can be between about 30-60 degrees, or also between about 40-50 degrees, relative to the bottom surface 134. In the illustrated embodiment, an upper portion of the back access wall 184 is inclined so as to accommodate entry of the primary insert 44 through the access port 180.

Figure 4:
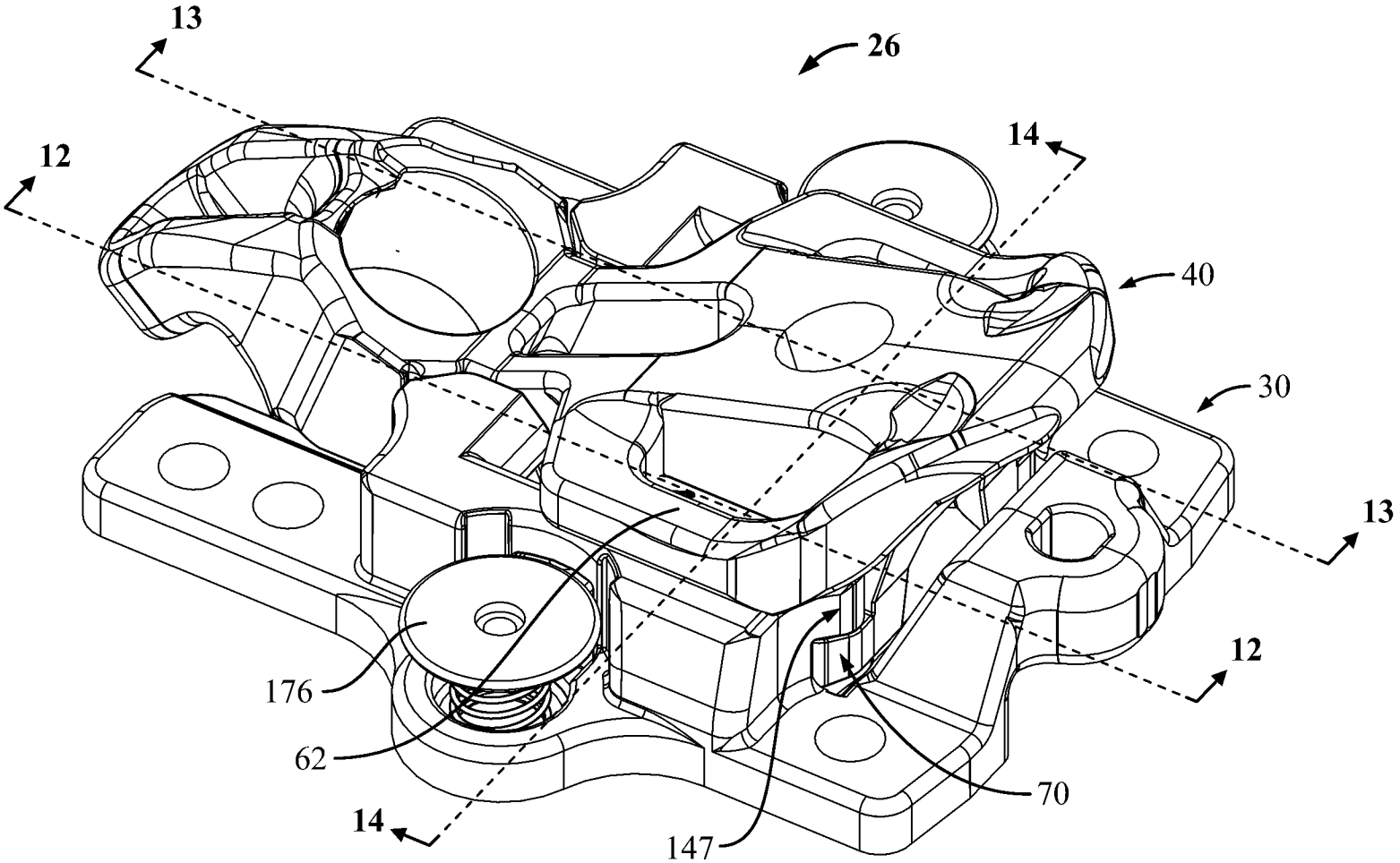
FIG. 4 shows the deck plate and base of FIG. 2 in a coupled configuration.
Figure 12:
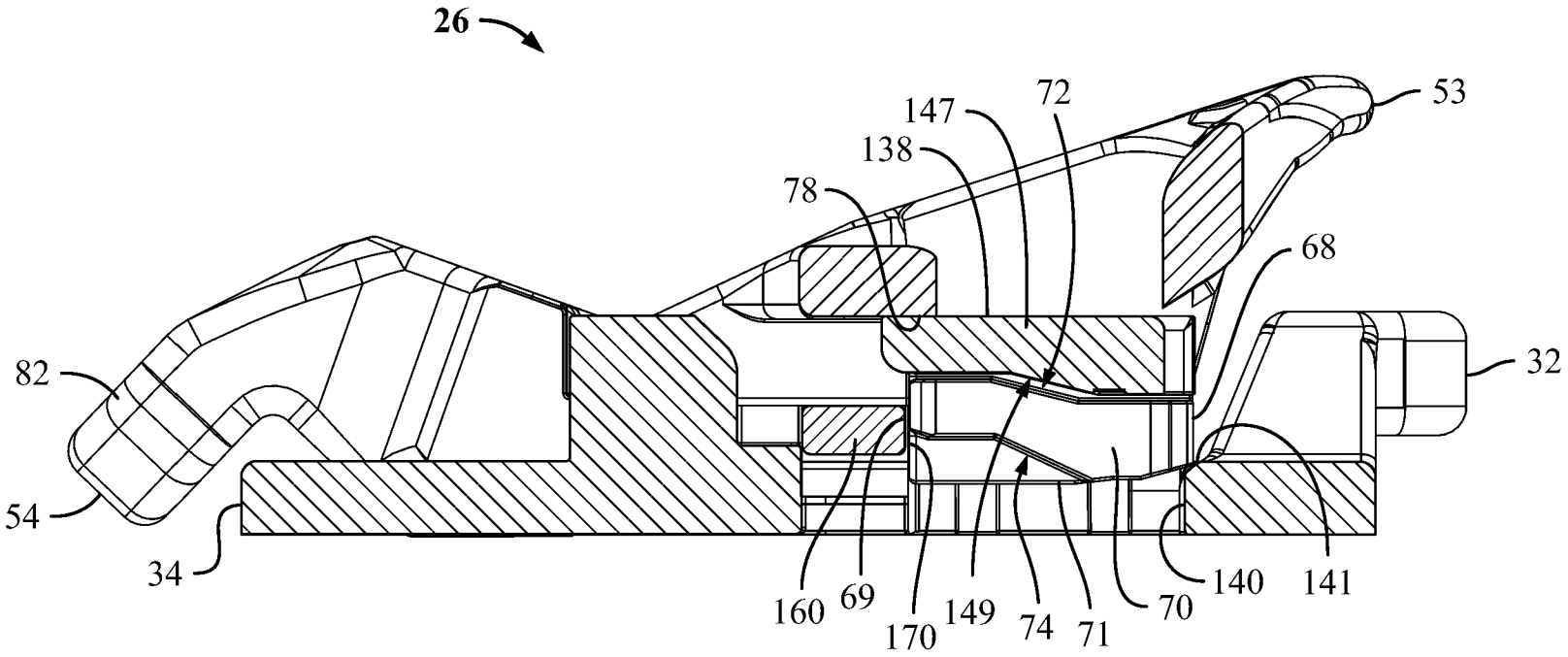
FIG. 12 is a cross-sectional view taken along line 12-12 of FIG. 4.
Figure 13:
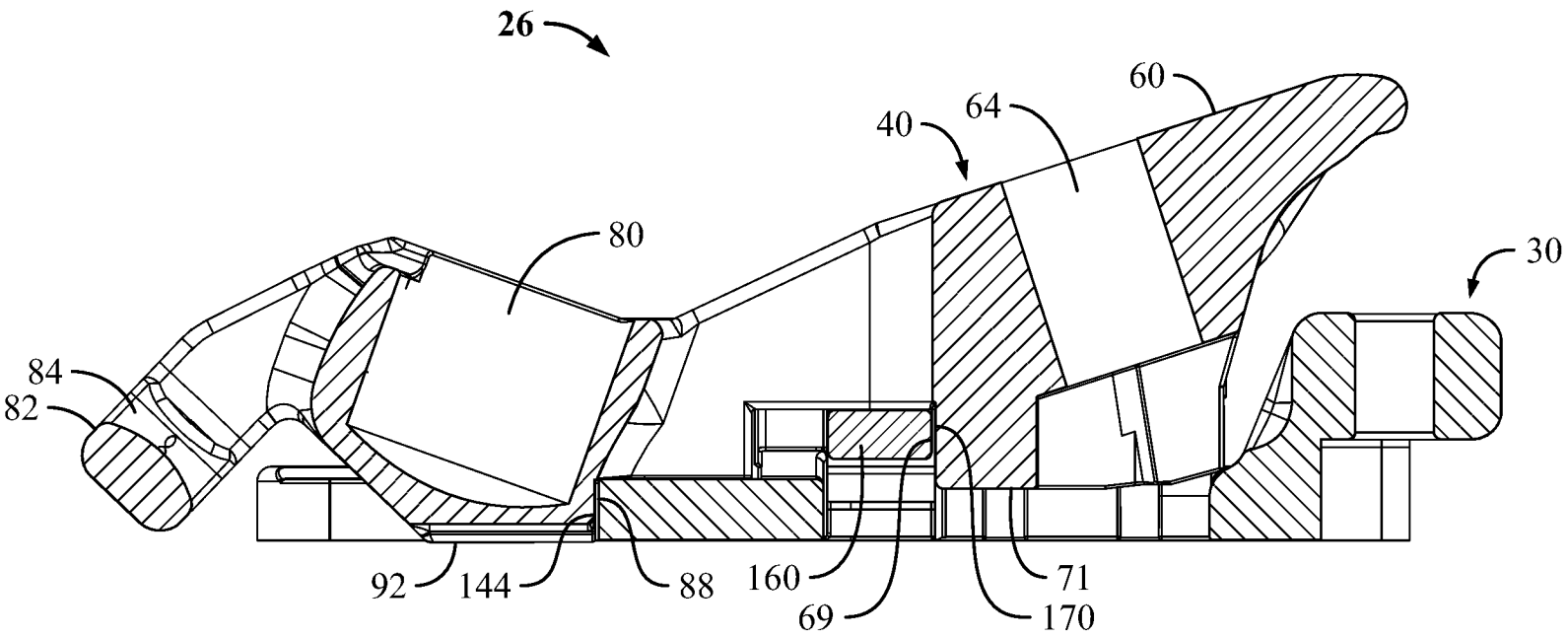
FIG. 13 is a cross-sectional view taken along line 13-13 of FIG. 4.

With reference next to FIGS. 4 and 12, once the back wall 69 has advanced proximally past the back access wall 184, the base 40 can be rotated so that the bottom surface 92 of the secondary insert 46 engages or nearly engages the skateboard deck 28, or is about even and coplanar with the bottom surface 134 of the deck plate 30. The base 40 can then be advanced proximally until the front wall 68 of the primary insert 44 engages the front wall 140 of the primary pocket 42. At this position, the back wall 69 will have just cleared the retaining member 160, and the spring-biased retaining member 160 will automatically be advanced vertically into engagement with the track top wall 156, which is its default position. With the retaining member 160 in its default position, the front surface 170 of the retaining member 160 will be immediately adjacent, yet proximal to, the back wall 68 of the insert 44. Thus, distal movement of the base 40 is blocked by the front surface 170 of the retaining member 160, and the primary insert 44 is held securely within the primary pocket 42. In this arrangement, the base 40 is coupled with the deck plate 30, as depicted in FIG. 4.

With particular reference to FIGS. 5, 9 and 11, in the illustrated embodiment the bottom contoured surface 74 of each insert extension 70 comprises a front portion 190, a back portion 191 vertically higher than the front portion 190, and an inclined portion 192 therebetween. The upper contoured surface 72 also comprises a front portion 193, a back portion 194 vertically higher than the front portion 193, and an inclined portion 195 therebetween. Further, the contoured restraining surface 149 of the restraining member 147 is formed complementary to the upper contoured surface 72, also comprising a front portion 196, a back portion 197 vertically higher than the front portion 196, and an inclined portion 198 therebetween. Also, an upper portion of the back access wall 184 of the access port 180 can be inclined. This configuration facilitates insertion of the primary insert 44 through the access port 180 while minimizing the size of the access port 180. It is, of course, contemplated that various specific designs of restraining structures can be employed in other embodiments and variations applying the principles discussed herein.

As shown in FIG. 12, in the illustrated embodiment, the front wall 68 of the primary insert 44, or at least an edge at which the front wall 68 intersects the bottom surface 71, engages an inclined portion 141 of the primary pocket front wall 140. As such, the inclined portion 141 urges the insert extensions 70 upwardly into engagement with the corresponding restraining member 147 so that the front and back portions 193, 194 of the upper contoured surface 72 engage the respective front and back portions 196, 197 of the contoured restraint surface 149, which block upward movement of the base 40 relative to the deck plate 30. In the illustrated embodiment, the bottom surface 71 is spaced vertically higher than the bottom surface 134 of the deck plate 30.

Figure 14:
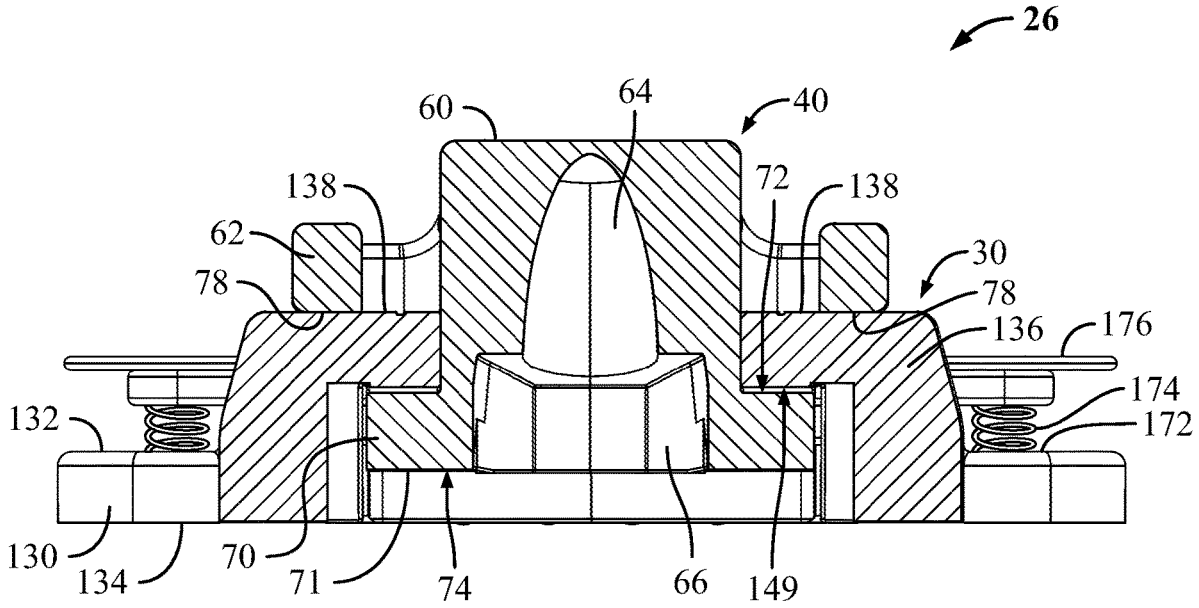
FIG. 14 is a cross-sectional view taken along line 14-14 of FIG. 4.

With continued reference to FIGS. 4 and 12, and additional reference to FIG. 14, when the base 40 is coupled to the deck plate 30, the proximal support surface 78 of the wings 62 rests upon the plate surface 138. More specifically, the plate surface 138 blocks downward movement of the proximal support surface 78—and associated base 40—relative to the deck plate 30.

With reference next to FIGS. 3-5, 8-10 and 13, as the base 40 is advanced forwardly during insertion but after rotation of the base 40, the secondary insert 48 advances into the secondary pocket 46. As the secondary pocket 46 is open at its distal end, there are no obstructions to the secondary insert 48 advancing into the secondary pocket 46. The front walls 88, **88*a* and side walls 86 of the secondary insert 48 are complementary to the respective front walls 144, 144*a* and side walls 146 of the secondary pocket 46 so that these structures register with one another and block forward and side-to-side movement, as well as twisting about a vertical axis, of the secondary insert 48 relative to the secondary pocket 46. The base 40 and deck plate 30 preferably are sized and configured so that the front wall 68 engages the front wall 140 simultaneously with the front wall 88 engaging the front wall 144 and the retaining member 160 being released to move to its default position immediately adjacent the back wall 69**.

As best shown in FIGS. 7-9, a base support surface 200 is disposed on either side of and generally proximal of the secondary pocket 46. A distal retaining member 202 is formed in each raised portion 136 distal of the access port 180. The distal retaining member 202 extends inwardly toward the axis 31 and terminates at a waist wall 204. A plate lock surface 206 is formed by a bottom surface of the distal retaining member 202, and a lock space 208 is defined between the base support surface 200 and the plate lock surface 206. As the base 40 is advanced proximally relative to the deck plate 30, the distal lock part 95 advances into the lock space 208. As such, and as shown in FIG. 12, when the base 40 is coupled with the deck plate 30 the distal support surface 90 of the base 40 rests upon the base support surface 200 of the deck plate 30 and the distal lock surface 94 of the base 40 registers with the plate lock surface 206 of the deck plate 30. This configuration provides additional resistance to upward and downward translation, as well as blocking rotation of the base 40 relative to the deck plate 30 about any axis.

In the embodiment discussed above, engagement of the primary insert 44 with the primary pocket 42, when coupled, comprise structure that blocks relative movement of the base 40 relative to the deck plate 30 in all translational and rotational directions. Similarly, engagement of the secondary insert 48 with the secondary pocket 46, when coupled, comprise structure that blocks relative movement of the base 40 relative to the deck plate 30 in all translational and rotational directions except in the distal direction. As shown, the primary insert 44/primary pocket 42 and secondary insert 48/secondary pocket 46 are spaced from one another. Such redundant, spaced apart blocking structures applied in a spaced-apart manner enhance one another's operability, and provide a durable, reliable attachment structure with very little play, enabling the truck system 26 to provide exceptional performance.

Figure 15:
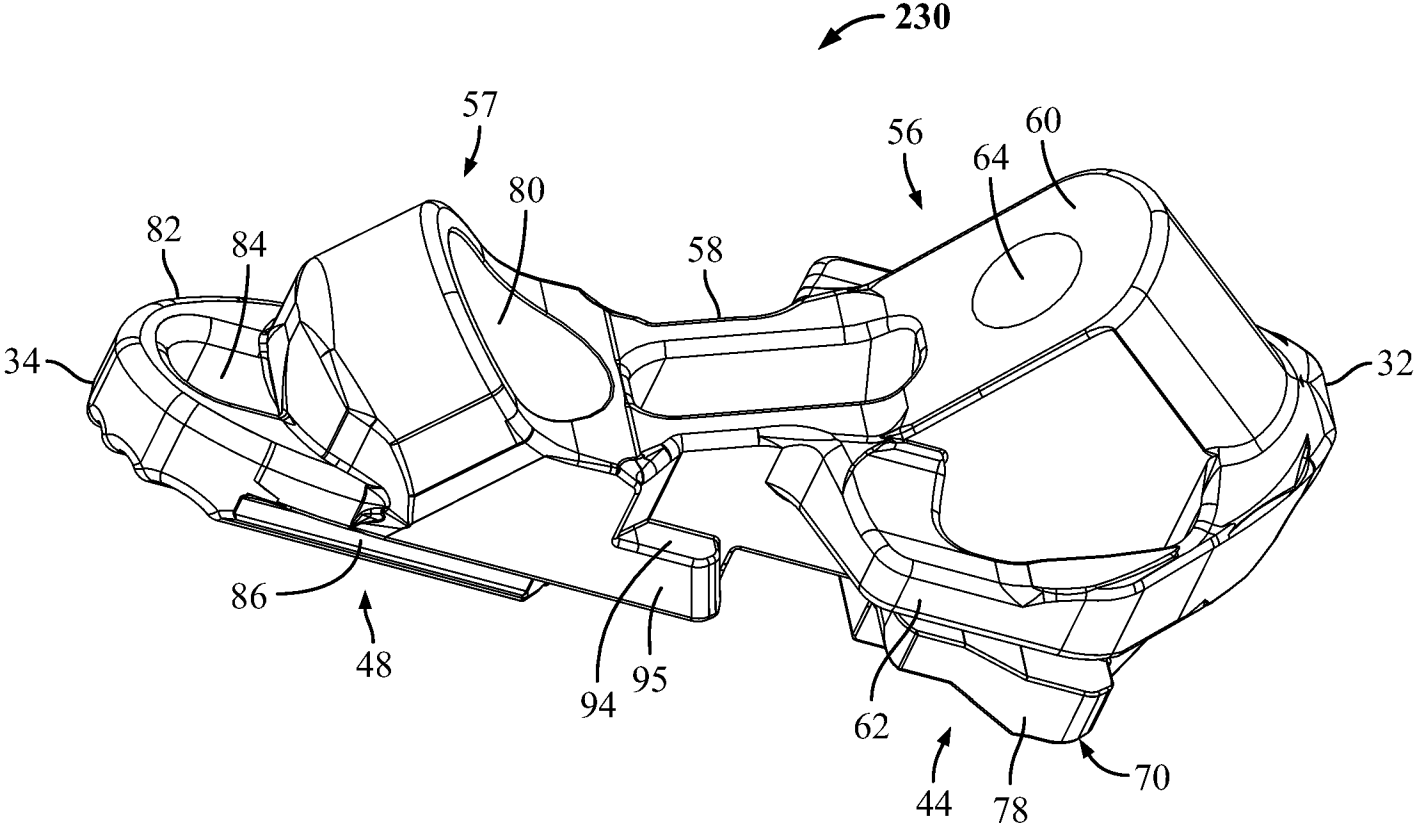
FIG. 15 is a perspective view of another embodiment of a base that is compatible with the deck plate of FIG. 2.

With reference next to FIG. 15, another embodiment of a base 230 is illustrated. The illustrated base 230 is configured to support a longboard-style hanger assembly, and thus has some differences in the specific configuration of its inclined seat 60 and pivot cup 80 relative to the base 40 depicted in the embodiments of FIGS. 1-14. However, the primary insert 44, secondary insert 48, and associated structures of base 230 are configured to be compatible with the primary pocket 42 and secondary pocket 46 of the deck plate 30 so that base 230 can be coupled with the deck plate 30. Indeed, it is contemplated that a user may have a set of several different bases 40, 230, upon which hanger assemblies having differing configurations/equipment may be mounted, and/or which may have different specific structure, but which are compatible with a single deck plate 30 so that bases 40, 230 can easily and quickly be substituted for one another to take advantage of the unique properties of a particular base 40/hanger assembly 50 setup when desired by the user. Although bases 40, 230 may be switched out, the deck plate 30 remains installed upon the skateboard deck 28.

Figure 16:
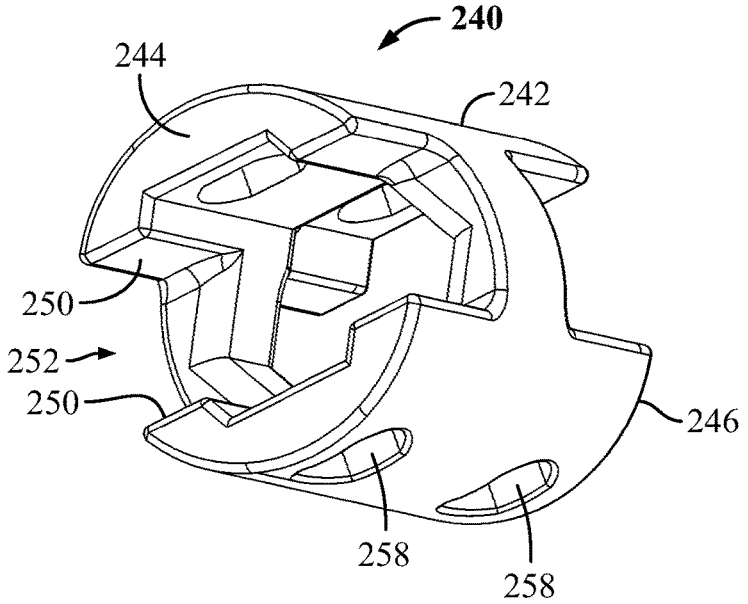
FIG. 16 is a perspective view of a socket for use with an embodiment of the truck system.
Figure 17:
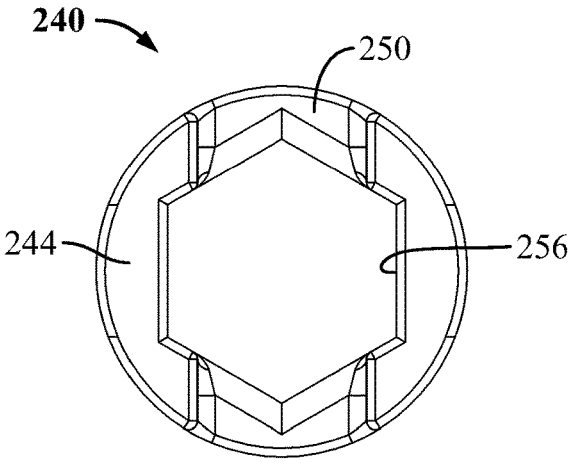
FIG. 17 is an end view of the socket of FIG. 16.

With reference next to FIGS. 16-19, additional embodiments can employ a tool system for use with the truck system 26. With reference specifically to FIGS. 16 and 17, a socket 240 can comprise an elongated and hollow cylindrical socket body 242 that extends from a first end 244 to a second end 246. A pair of opposing receiver slots 250 are disposed at each end, and are defined by a first wall 252 and a second wall 254 that are spaced from one another a distance that is about the same as a height of the distal extension 82 of the base 40. A first keyed cavity 256 is arranged opening to the first end 244. The first keyed cavity 256 is shaped to be complementary to one of the kingpin nut 116 and axle nuts 122, and is configured to register with such nut as would a wrench-type socket. A second keyed cavity (not shown) preferably is arranged opening to the second end 246 and is shaped to be complementary to the other of the kingpin nut 116 and axle nuts 122. A pair of apertures 258 is provided adjacent each end 244, 246. Each pair of apertures 258 is aligned with one another along an axis transverse to a longitudinal axis of the socket 240.

Figure 18:
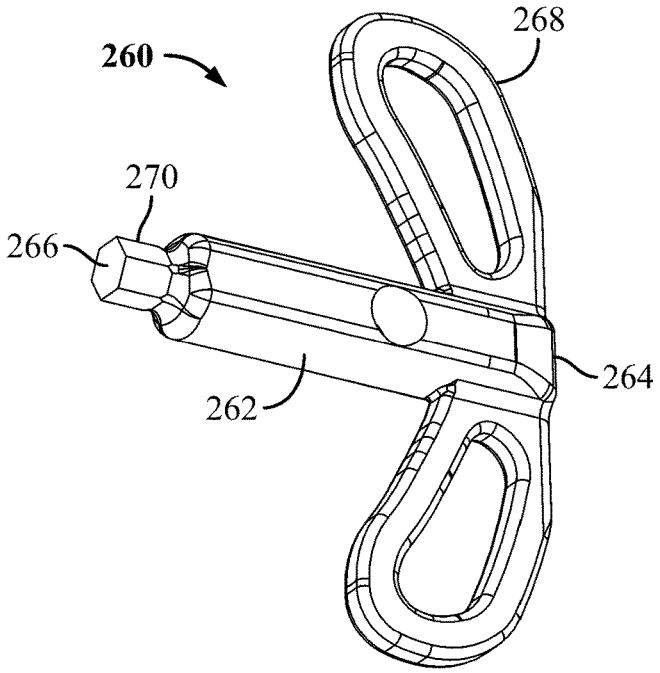
FIG. 18 is a perspective view of a locking pin configured to be used with the socket of FIG. 16 and the base of FIG. 2.

As best shown in FIG. 18, a pin 260 has an elongated body 262 extending from a proximal end 264 to a distal end 266. A pair of handles 268 is provided adjacent the proximal end 264. In the illustrated embodiment, an allen key 270 is provided at the distal end 266.

Figure 19:
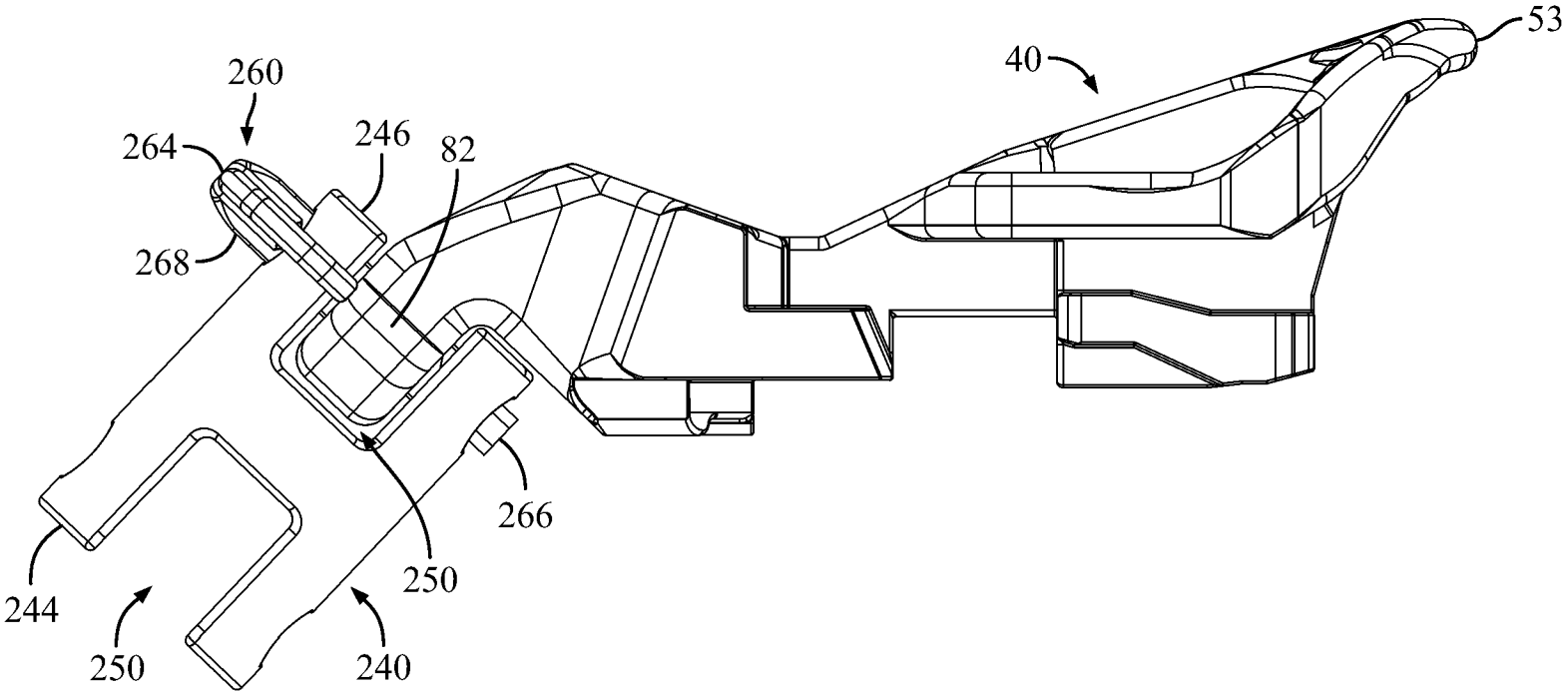
FIG. 19 is a side view showing the base of FIG. 2 with the socket and locking pin attached thereto.

With specific reference next to FIG. 19, either one of the receiving slots 250 of the socket 240 can receive the distal extension 82 so that the extension aperture 84 is aligned with socket apertures 258. The elongated body 262 of the pin 260 can be advanced through the socket apertures 258 and extension aperture 84 so as to hold the socket 240 in place on the distal extension 82. In some embodiments, a detent structure, such as a spring-loaded ball plunger, can be employed on the pin 260 so as to selectively keep the pin 260 in its place holding the socket 240 onto the distal extension 82. As illustrated in FIG. 19, the socket 240 is thus temporarily attached to the base 40. The first keyed cavity 256 thus is available to engage and tighten or loosen the corresponding one of the kingpin nut 116 or wheel nut 122. As desired, the socket 240 can be removed from the distal extension 82 and reattached in an opposite configuration so that the second keyed cavity is available for use to actuate one of the kingpin nut 116 and wheel nut 122. As such, the base 40 can be part of a tool system for adjusting parts of the hanger assembly.

This specification has described specific structures that implement inventive principles to provide improved performance. However, it is to be understood that inventive principles discussed herewithin can be implemented employing structure that is different than that specifically presented herein. For example, another embodiment could employ two or more secondary insert/secondary pocket pairs disposed laterally next to one another. Further embodiments could arrange engaging surfaces in different manners or locations, or the like, and such surfaces can be shaped or contoured differently than as specifically discussed herein. Further, it is contemplated that one or more of the engaging surfaces can be coated with a plastic layer or the like. Thus, to the extent that there may be slight relative motion between adjacent surfaces, noise from such relative motion will be buffered/reduced by the plastic layer.

Although inventive subject matter has been disclosed in the context of certain illustrated embodiments, aspects, variations and examples, it will be understood by those skilled in the art that the inventive subject matter extends beyond the specifically disclosed embodiments to other alternative embodiments and/or uses of the invention and obvious modifications and equivalents thereof, as just described above. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. For example, certain structures of the primary insert and primary pocket could be employed by the secondary insert and secondary pocket. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A skateboard truck system, comprising:

a deck plate having a bottom surface configured to rest against a skateboard deck and a top surface spaced from and opposite of the bottom surface, a primary pocket comprising opposing side surfaces and a primary retaining member above each side surface and extending toward an axis of the deck plate, each primary retaining member defining a retaining surface facing towards the top surface of the deck plate;

a retaining member traversable between a locked position and an unlocked position and spring-biased toward the locked position; and a base having a primary insert, a seat surface and a pivot receiver, the seat surface being on an upper surface of the base and having an aperture to have at least one part of a hanger assembly mounted on the seat surface, the pivot receiver configured to receive a pivot extension of the hanger assembly to allow for the hanger assembly to pivot, and the primary insert having an upper surface, side walls, and a back wall;

wherein the primary insert and the primary pocket are sized and configured so that the primary insert can be received within the primary pocket and when the primary insert is received within the primary pocket, the retaining member is in the locked position, the primary insert side walls register with the opposing side surfaces of the primary pocket, the primary insert upper surface registers with the primary pocket retaining surfaces, and the primary insert back wall registers with the retaining member.

2. The skateboard truck system of claim 1, wherein the base comprises a support surface, and wherein when the primary insert is received within the primary pocket the support surface is engaged with the top surface of the deck plate.

3. The skateboard truck system of claim 1, wherein an access port of the deck plate is sized and configured to accommodate the primary insert passing therethrough, the retaining member positioned to block the access port when the retaining member is in a default position.

4. The skateboard truck system of claim 1 wherein the retainer member is elongate transverse to a forward direction of the skateboard deck, the retainer member defining first and second opposed end portions, the system further comprising first and second springs which are disposed at the first and second opposed end portions to bias the first and second end portions of the retaining member in the locked position so that to traverse the retaining member to the unlocked position, both the first and second end portions of the retaining members must be depressed.

5. A skateboard truck system, comprising:

a deck plate having a bottom surface configured to rest against a skateboard deck and a top surface spaced from the bottom surface, a primary pocket comprising a plurality of primary surfaces, and a secondary pocket comprising a plurality of secondary surfaces, the secondary pocket being spaced from the primary pocket; and a base having a primary insert having a plurality of primary insert surfaces, a secondary insert having a plurality of secondary insert surfaces, a seat surface and a pivot receiver, the seat surface and pivot receiver configured so that a hanger assembly can be mounted onto the base;

wherein the base and deck plate are sized and configured so that the base can be selectively coupled with the deck plate by advancing the primary insert into the primary pocket and the secondary insert into the secondary pocket, the primary insert surfaces configured to register with the primary surfaces so as to block lateral movement of the base relative to the deck plate, the secondary insert surfaces configured to register with the secondary surfaces so as to block lateral movement of the base relative to the deck plate.

6. The skateboard truck system of claim 5, wherein the deck plate additionally defines a track adjacent the primary pocket, and a retaining member is disposed within the track and configured to slide within the track, the retaining member being biased toward a default position.

7. The skateboard truck system of claim 6, wherein the deck plate additionally comprises an access port aligned with the primary pocket, the access port sized and configured to accommodate the primary insert passing therethrough, the retaining member positioned to block the access port when the retaining member is in the default position.

8. The skateboard truck system of claim 7, wherein the secondary pocket comprises a secondary aperture formed through the bottom surface of the deck plate, the secondary aperture having a front surface and a back opening, and wherein the secondary aperture is unobstructed moving longitudinally from the back opening to the front surface.

9. The skateboard truck system of claim 8, wherein the secondary insert is configured to slide within the secondary pocket so that a front wall of the secondary insert engages a front wall of the secondary pocket when the base is coupled with the deck plate.

10. The skateboard truck system of claim 7, wherein the primary insert is configured to fit through the access port when inclined at an angle between 15-75 degrees relative to the deck plate.

11. The skateboard truck system of claim 5, wherein the base comprises a proximal portion and a distal portion, the primary insert being formed in the proximal portion, the secondary insert being formed in the distal portion.

12. The skateboard truck system of claim 11, wherein a distal portion of the deck plate at or adjacent the secondary pocket comprises a base support surface and a plate lock surface, and a distal lock portion is formed in the distal portion of the base, and wherein the distal lock portion is sized and configured to slide into a lock space between the plate lock surface and base support surface.

13. The skateboard truck system of claim 5, wherein when the base is coupled with the deck plate a bottom surface of the secondary insert is generally even with a bottom surface of the deck plate.

14. The skateboard truck system of claim 13, wherein when the base is coupled to the deck plate a bottom surface of the primary insert is spaced from the bottom surface of the deck plate.

15. The skateboard truck system of claim 5, wherein a distal extension is formed on the base, and additionally comprising a socket configured to be releasably attached to the distal extension, the socket defining a keyed cavity sized and configured to complementarily fit with a nut of a hanger assembly.

16. A method of assembling a skateboard truck system comprising:

advancing a base toward a deck plate that is attached to a skateboard deck in a manner so that a bottom surface of the deck plate is engaged with the skateboard deck, a top surface of the deck plate defining an access port therethrough, a primary pocket adjacent the access port, a retainer member disposed within the access port and being slidable between an open position and a default position, the retainer member being biased to the default position;

advancing a primary insert of the base into the access port at an incline between 15-75 degrees relative to the deck plate bottom surface;

rotating the base; and advancing the base longitudinally relative to the deck plate in a direction parallel to the deck plate bottom surface to a coupled position;

wherein when the base is in the coupled position a plurality of primary insert surfaces engage a corresponding plurality of primary pocket surfaces so as to block movement of the base relative to the deck plate.

17. The method of claim 16, wherein when the primary insert is advanced into the access port at an inclined, the primary insert pushes the retainer member out of the way, and when the base is advanced longitudinally relative to the deck plate the primary insert moves over the retainer member.

18. The method of claim 17, wherein when a back wall of the primary insert is advanced past the retainer member, the retainer member is again biased to the default position.

19. The method of claim 16, wherein the deck plate comprises a secondary pocket spaced longitudinally from the primary pocket, the secondary pocket comprising a secondary aperture formed through the deck plate and defining a front wall, opposing side walls, and a back opening, wherein when the base is advanced longitudinally relative to the deck plate in the direction parallel to the deck plate bottom surface a secondary insert of the base advances through the back opening and into the primary secondary pocket.

20. The method of claim 19, wherein when the base is in the coupled position, a front wall of the secondary insert is engaged with the front wall of the secondary aperture.

* * * * *